US006749201B2

(12) United States Patent
Kessler, Jr. et al.

(10) Patent No.: US 6,749,201 B2
(45) Date of Patent: Jun. 15, 2004

(54) STACKABLE WASHER TOSSING GAME APPARATUS AND METHOD OF PLAY

(76) Inventors: James Lloyd Kessler, Jr., 2414 Cannery Ct., Imperial, MO (US) 63052; Arthur L. Loeffelman, 8 Daybreak, St. Louis, MO (US) 63128; Arthur Lance Loeffelman, 12814 Gravois Rd., St. Louis, MO (US) 63127

( * ) Notice: Subject to any disclaimer, the term of this patent is extended or adjusted under 35 U.S.C. 154(b) by 0 days.

(21) Appl. No.: 10/150,116

(22) Filed: May 16, 2002

(65) Prior Publication Data

US 2002/0175469 A1 Nov. 28, 2002

Related U.S. Application Data

(60) Provisional application No. 60/292,609, filed on May 23, 2001.

(51) Int. Cl.[7] ..... A63B 67/06
(52) U.S. Cl. ..... 273/400; 273/336
(58) Field of Search ..... 273/398–402, 273/288, 336–339; 473/588, 589

(56) References Cited

U.S. PATENT DOCUMENTS

| | | | | | |
|---|---|---|---|---|---|
| 324,189 | A | | 8/1885 | Thomas | |
| 972,597 | A | | 10/1910 | Byl | |
| 979,109 | A | * | 12/1910 | Underhill | 273/400 |
| 3,628,793 | A | | 12/1971 | Mudloff | |
| 4,243,229 | A | | 1/1981 | Huser et al. | |
| 4,392,653 | A | * | 7/1983 | Blume, Sr. | 273/400 |
| 4,928,968 | A | * | 5/1990 | Gebert | 273/357 |
| 4,982,966 | A | * | 1/1991 | Teafatiller | 273/338 |
| 4,989,880 | A | | 2/1991 | Gettemeier | |
| 5,018,745 | A | * | 5/1991 | Dunse | 273/338 |
| 5,040,801 | A | * | 8/1991 | Weymuth | 273/338 |
| 5,050,889 | A | | 9/1991 | Walker | |
| 5,056,797 | A | | 10/1991 | Hockert et al. | |
| 5,060,955 | A | | 10/1991 | Bible | |
| 5,201,527 | A | | 4/1993 | Koket | |
| 5,282,635 | A | * | 2/1994 | Hopkins | 273/342 |
| 5,351,968 | A | | 10/1994 | Starnes | |
| 5,533,734 | A | | 7/1996 | Husk | |
| 5,553,862 | A | | 9/1996 | Konotopsky | |
| 5,575,480 | A | * | 11/1996 | Wehr | 273/402 |
| 5,873,573 | A | * | 2/1999 | Beatty, Jr. | 273/336 |
| 5,882,010 | A | | 3/1999 | Geror | |
| 6,161,833 | A | | 12/2000 | Gomez | |

* cited by examiner

*Primary Examiner*—Mark S. Graham
(74) *Attorney, Agent, or Firm*—Kevin L. Klug

(57) ABSTRACT

A stackable washer tossing game apparatus and method of play which allows a player to easily stack, store, and transport the scoring boxes. The apparatus incorporates a removable center scoring pin with the game. The apparatus also comprises a scoring box having an inside gripping surface which minimizes bounce of the washers used in the game. The apparatus further comprises washers having an impact absorbing coating which further minimizes bounce. The washers of the apparatus having an outside diameter or periphery which has a plurality of dimples or serrations which further minimizes rolling of said washers.

12 Claims, 9 Drawing Sheets

STACKABLE WASHER TOSSING GAME APPARATUS AND METHOD OF PLAY

This application claims priority of Provisional Patent Application No. 60/292,609, filed May 23, 2001.

BACKGROUND OF THE INVENTION

The present invention relates in general to washer tossing games and more particularly, to an apparatus and method which provides a washer tossing game with stackable scoring boxes, washer gripping surfaces within said scoring boxes, uniquely designed washer impact absorbing coatings, land removable extra point center pins.

Traditionally, washer tossing games comprise two scoring boxes each having an interior portion for capturing tossed washers. Said prior art boxes are typically manufactured from wood based materials in a square form open structure. The structure of the aforesaid limited stackability and transportability of the game. That is, the scoring boxes were not stackable for space reduction and did not have provisions for storing the washers which were used in the game. Further limitations of the prior art included the absence of any feature to limit the bounce of the washers as they entered the scoring box. This prior art limitation often allowed properly tossed washers to bounce out of the scoring box, thereby unfairly reducing a player's score. Still further limitations of the prior art limited recognition for a perfect center ringer toss. That is, the prior art scoring boxes did not provide a center scoring pin which could capture washers which land perfectly in the center. Even further limitations of the prior art reside in the absence of any coating, covering, or serrations on the washers themselves which limited rolling and bouncing.

Accordingly, it is an object of the present invention to provide a stackable washer tossing game apparatus and method of play which allows a player to easily stack, transport, and store the scoring boxes and washers utilized in the washer tossing game.

Another object of the present invention is to provide a stackable washer tossing game apparatus and method of play which minimizes washer bounce out of the inside box scoring area.

A further object of the present invention is to provide a stackable washer tossing game apparatus and method of play having a center scoring pin for capture and recognition of a tossed washer which lands perfectly in the center of the scoring box.

A still further object of the present invention is to provide a stackable washer tossing game apparatus and method of play having washers covered with an impact absorbing coating to minimize bounce.

A still further object of the present invention is to provide a stackable washer tossing game apparatus and method of play having washers with a serrated or dimpled edge along an outside diameter which minimizes rolling.

SUMMARY OF THE INVENTION

To accomplish the foregoing and other objects of this invention there is provided a stackable washer tossing game apparatus and method of play. The apparatus provides for a method of washer game play which minimizes washer bounce out of the scoring area and also allows for easy stackability, storage, and transportation of the scoring boxes used with the game.

Although the game of washers, much like the game of horseshoes, has been played in many forms over the years, the present apparatus and method of use represents improvements over the prior art which make the game quicker, easier, and more desirable to play. That is, the present apparatus includes scoring box improvements such as stackable mating scoring boxes which slidably interfit for transport and storage, a gripping surface in the base of each scoring box, one or more box anchors, center pin mounts, and center pin scorers for extra point scoring. Further improvements include a unique gripping surface on the outside base surface to minimize scoring box movement and uniquely shaped and coated washers which minimize roll and bounce.

A conventional washer game typically comprises a set of scoring boxes or areas, typically two, and a set of washers which are tossed into said boxes. Often the washers are marked to distinguish individual players. The scoring boxes often contain a center section which corresponds to extra points when a washer lands therein. Players typically obtain a point for placement of a washer in the scoring box and three points for placement into the center section, all from a distance of typically 30 feet.

For the present art, each scoring box represents a polygonally cross-section formed open top box having a bottom wall, one or more side walls connected thereto, an inside, an outside, and a raised center portion within said inside. The said center portion has an opening through the center. In a preferred embodiment, the scoring box has a lip around the outermost edge of said side walls extending to the outside of said open top. In a preferred embodiment, at least one lip hole is present for placement of at least one anchor pin, with preferably a lip hole placed at each corner of said polygonal shape. In a preferred embodiment, the open top box is substantially rectangular and the raised center portion is a slight conic not tapering to an apex, but opened in the center whereby washers may fall for additional point counts. In the preferred embodiment, there are four side walls. It is important to note that the scoring box and the raised center portion may be formed in any polygonal cross section shape without departing from the spirit and scope of the present invention, provided the desirable features of the present art are incorporated. It is further noted that the shape land preferred material of said scoring box allows floatation on the surface of water during use.

In the preferred embodiments, the side walls taper inward from the lip to the connection with the bottom wall whereby the distance between substantially parallel side walls is less at the bottom wall than at the lip. This tapering allows the scoring boxes to be stacked within each other and form a cavity therebetween. This stacking allows for easy storage and transport of washers, pins, and other accessories.

In the preferred embodiment, into the base of said raised center portion from said outside is placed abase plug. (The base plug removability option allows for the aforementioned stacking.) Said base plug substantially conforms in size with the center opening of said raised center. The base plug has a center hole portion which acts as a center pin mount into which a center scoring pin is mounted. In a preferred embodiment said base plug and said center scoring pin are frictionally held in place, but alternative embodiments may incorporation fasteners, screws, hooks, or other methods.

In a preferred embodiment, the center scoring pin is sized to fit within an inside diameter hole of a washer which is used in the game. The outside diameter of the washer is sized to fit within the center opening of said raised center portion. Each washer is coated with user identifiable markings which also act to protect the surface of the washer material. Further alternative embodiments incorporate an impact absorbing coating, such as rubber, on each washer which minimizes the bounce of each washer upon impact. In said alternative embodiments, the washer or its coating may contain serrations, dimples, or other non-uniform cuts or moldings on the outside diameter which minimize rolling of said washers. Still further alternative embodiments may utilize one or more rings as an accessory to the apparatus and during the method of play instead of said washers, all without departing from the spirit of the present invention.

In the preferred embodiment, a gripping surface is placed on the bottom wall of the inside of said scoring box. Said gripping surface slows the movement of the washer when it contacts the bottom wall of the scoring box, thereby helping to prevent the washer from bouncing out. In a preferred embodiment, the gripping surface comprises a plurality of projections which extend away from said bottom wall. Said projections engage and interfit within the inside diameter hole of said washer and also protrude upon the washer outside diameter, thereby limiting the movement of said washer in said scoring box. Alternative embodiments may incorporate other means to create a gripping surface. These include but are not limited to adhesives, hook and loop fasteners, magnetic attraction, or vacuum holding. The preferred embodiment further places an outside gripping surface, preferably in the form of said plurality of projections, on the outside of said bottom wall to limit sliding movement of the scoring box.

In preferred operation and use, the players separate the scoring boxes from the stacked and stored position. A base plug having a center scoring pin thereon mounted is placed within the center opening of said raised center portion for each scoring box. (alternative play methods may forego use of said center scoring pin) Each scoring box is then separated approximately 30 feet. Alternative embodiments may separate the scoring boxes more or less than 30 feet. One or more anchor pins may be placed through a lip hole to help secure the scoring box to a surface. As with the center scoring pin, anchor pin use is optional. Alternatively, the players may desire to play on a water surface. In this case, the players would simply place the scoring boxes on the water surface and allow them to float in place.

During play, each player obtains marked washers, stands near a scoring box, and begins tossing toward the other scoring box. In a preferred method of play, if a washer lands within the scoring box but not within the center opening, it counts for one point. If a washer lands within the center opening but not onto the center scoring pin, it counts for three points. If a washer lands within the center opening and also onto the center scoring pin, it counts for five points. In a preferred method, the first player to obtain 21 points wins the game.

The apparatus and all of its parts may be manufactured from a variety of materials including but not limited to plastics, metals, woods, composites, various rubber materials, leathers, or any other material capable of withstanding the impact of washers.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
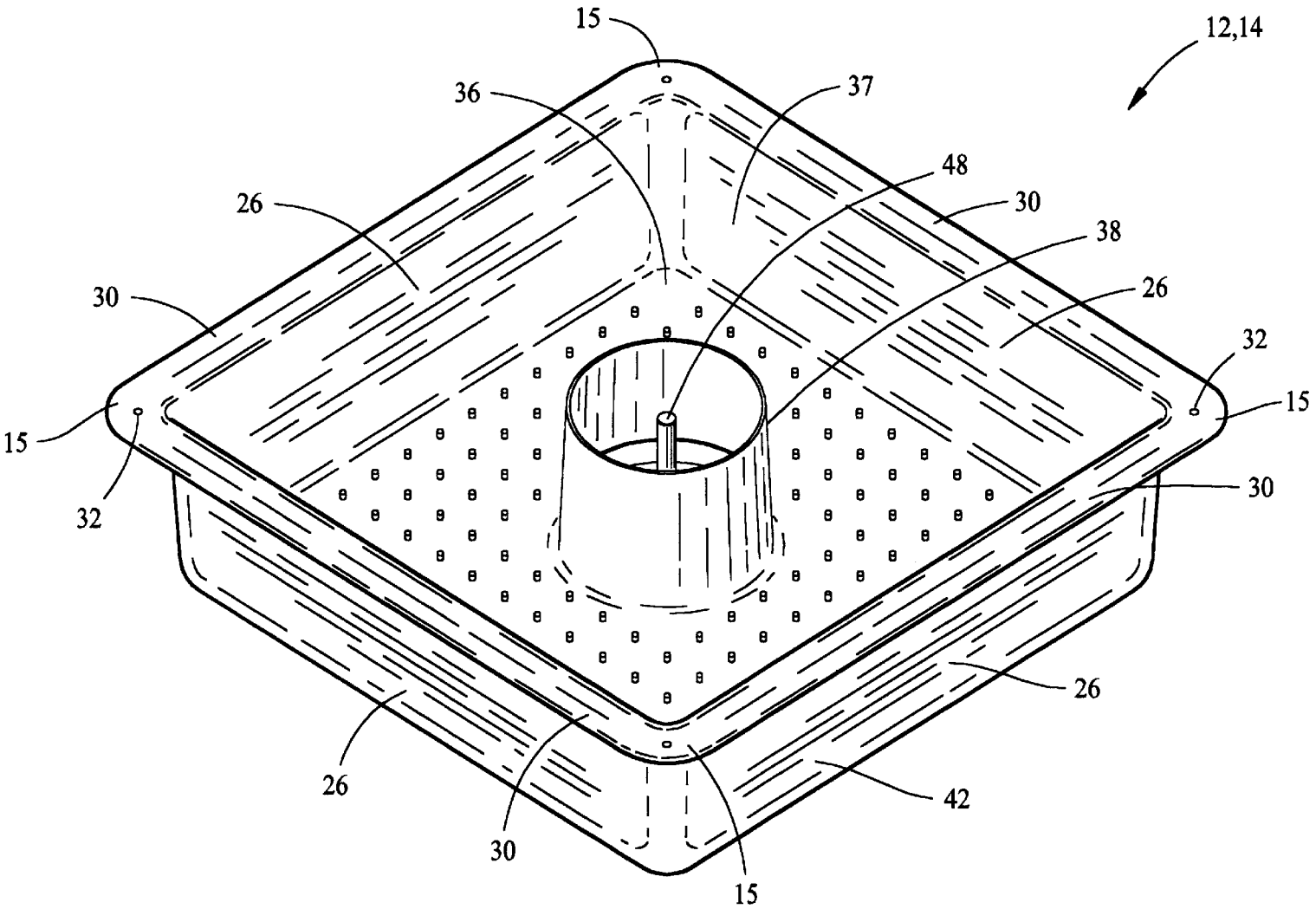
FIG. 1 is a perspective view of a stackable washer tossing game apparatus showing a single scoring box with base plug and pin included.
Figure 2:
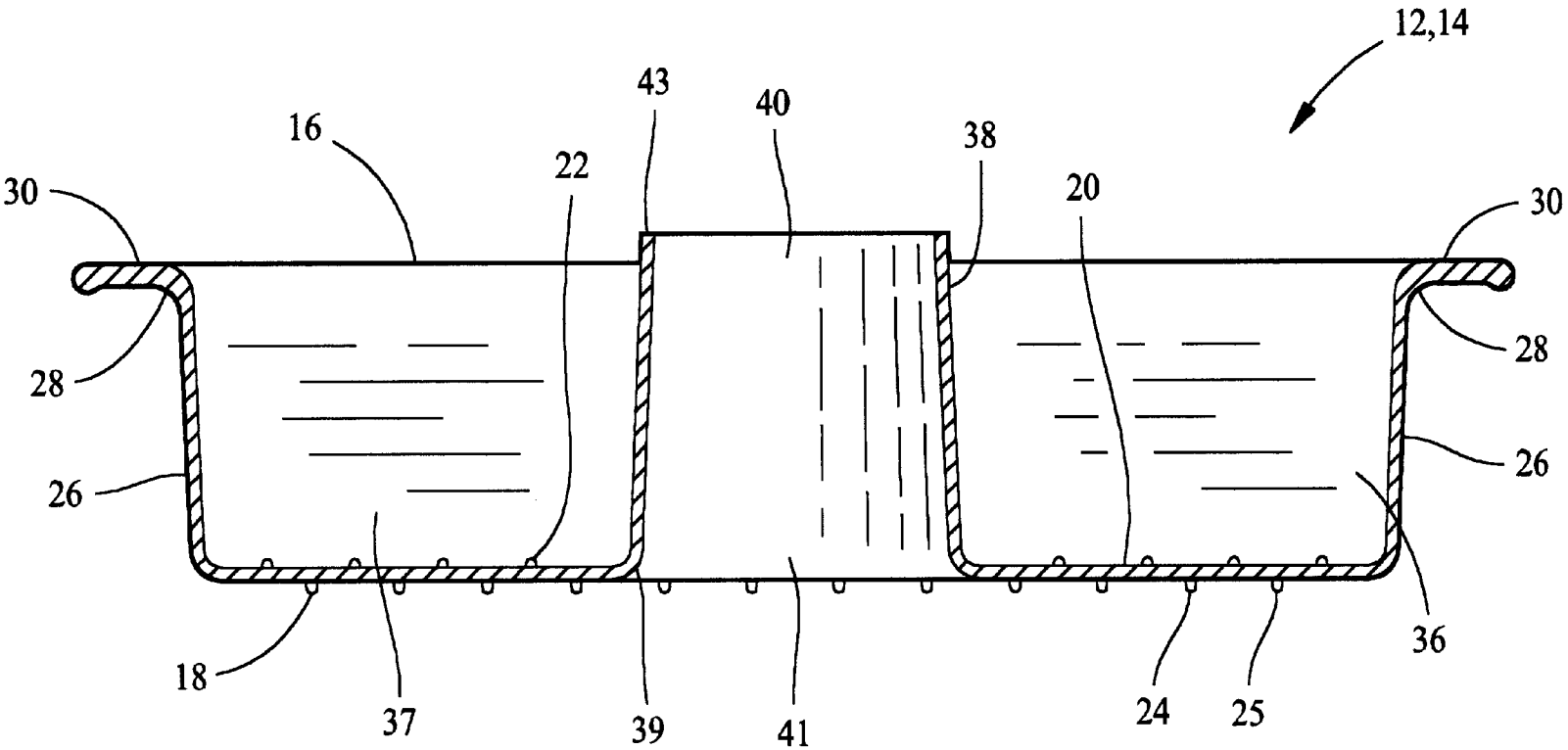
FIG. 2 is a cross sectional view of the scoring box with base plug and pin included taken across line 3–3A center section of FIG. 3.
Figure 3:
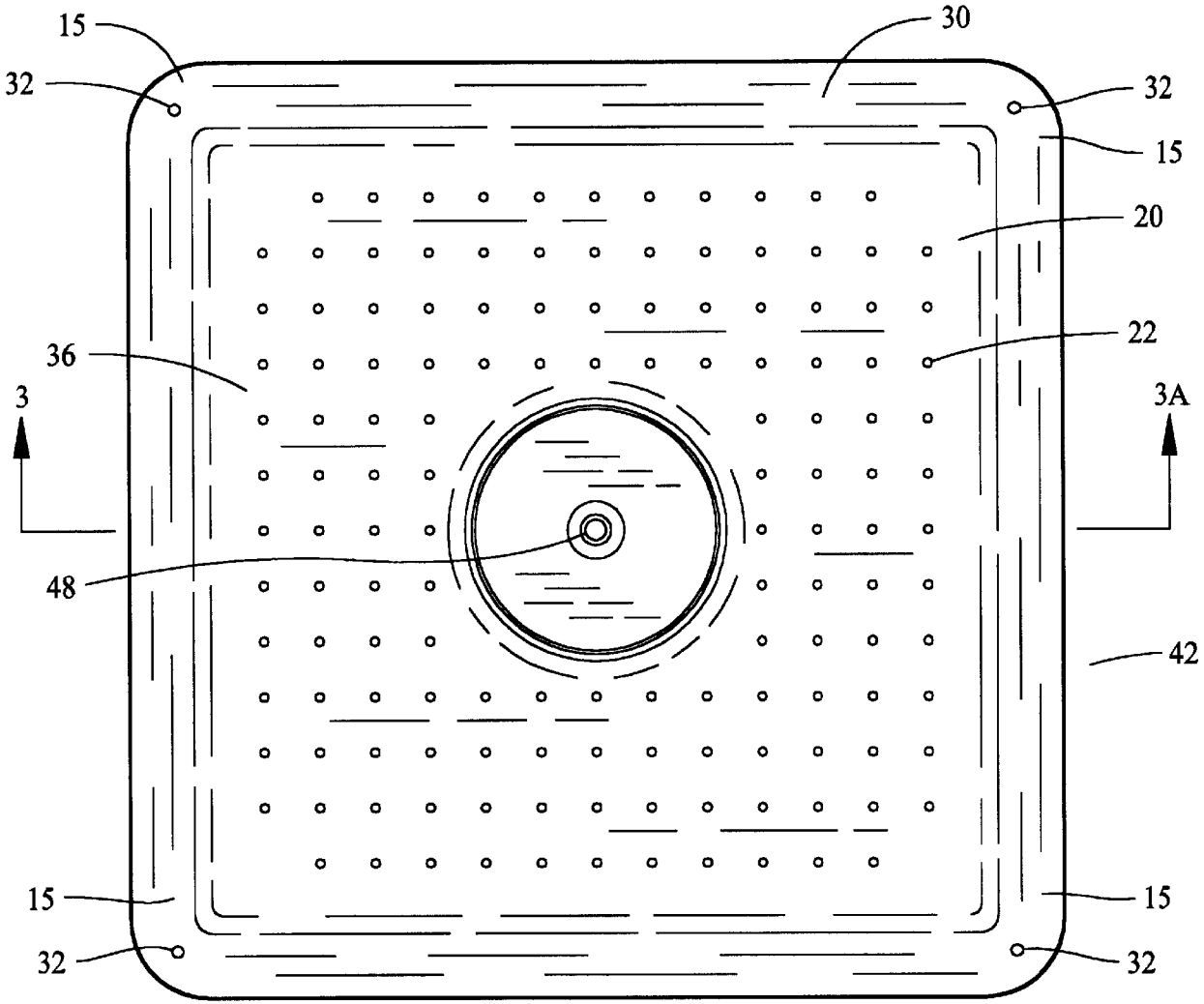
FIG. 3 is a top plan view of a stackable washer tossing game apparatus scoring box with base plug and pin included.
Figure 4:
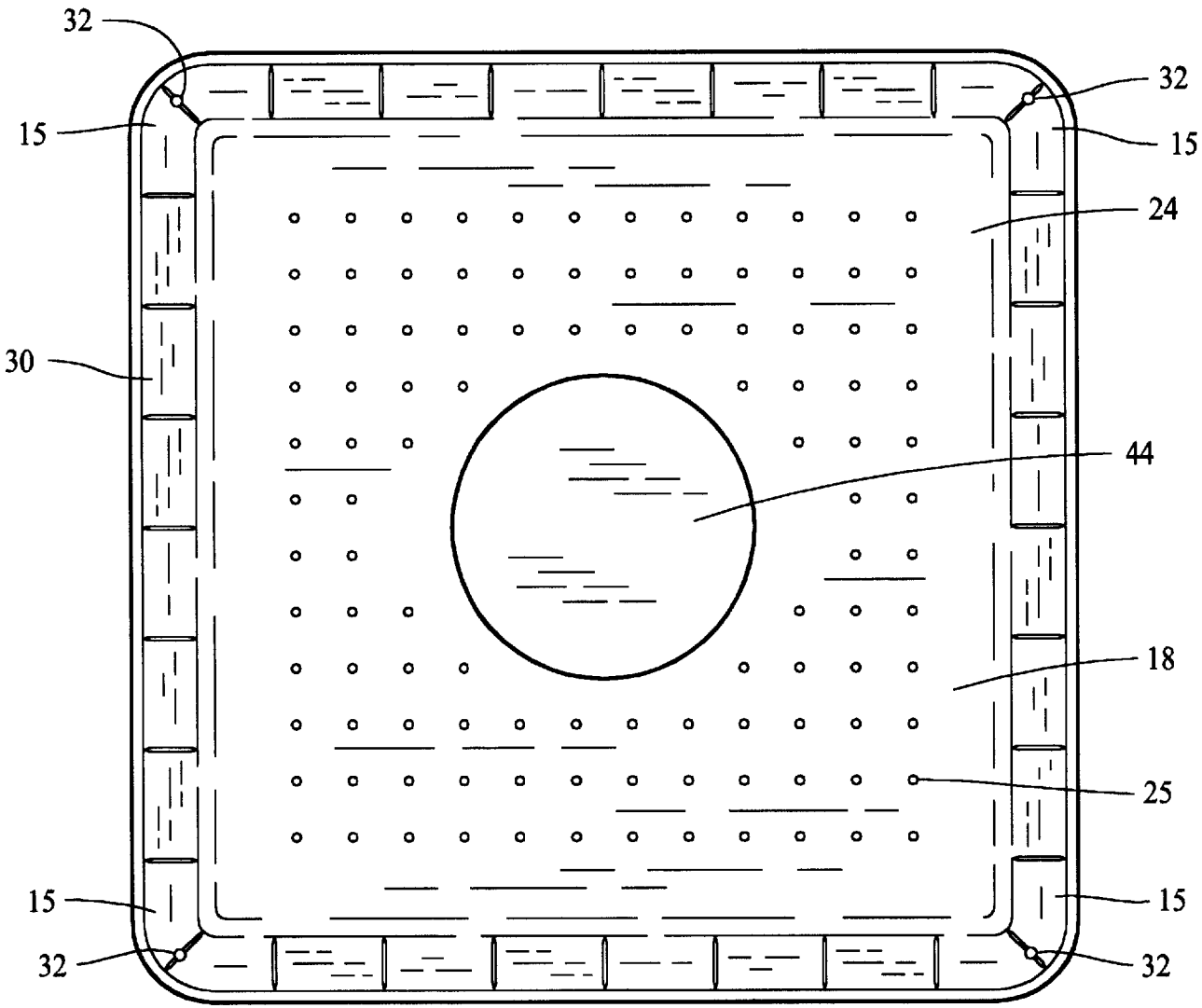
FIG. 4 is a bottom plan view of a stackable washer tossing game apparatus scoring box with base plug included.
Figure 5:
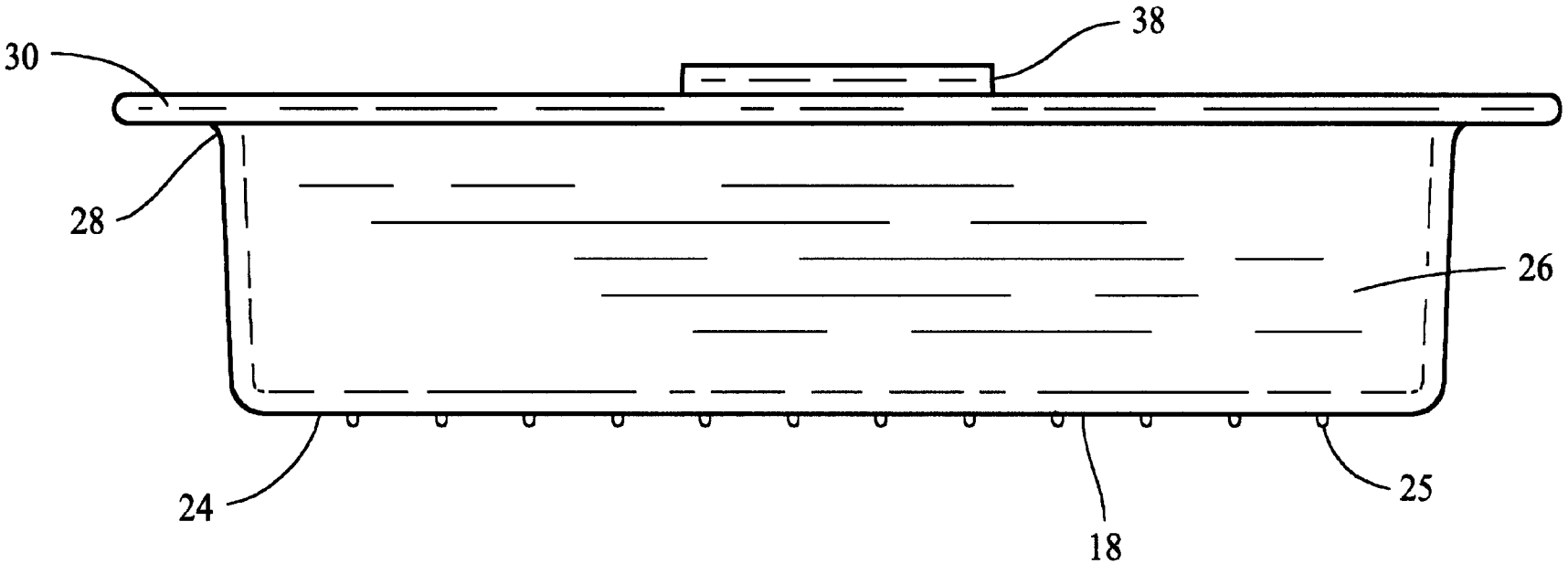
FIG. 5 is a right side plan view of a stackable washer tossing game apparatus scoring box with base plug included.
Figure 6:
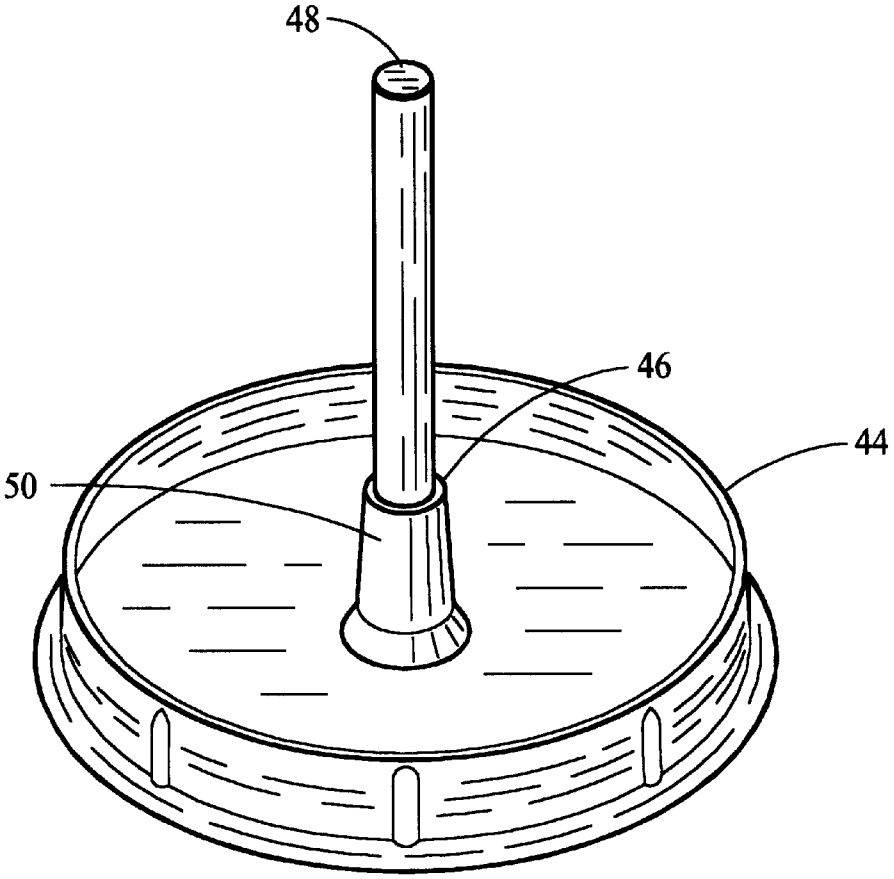
FIG. 6 is a perspective view of a base plug with a center scoring pin of a stackable washer tossing game apparatus.
Figure 7:
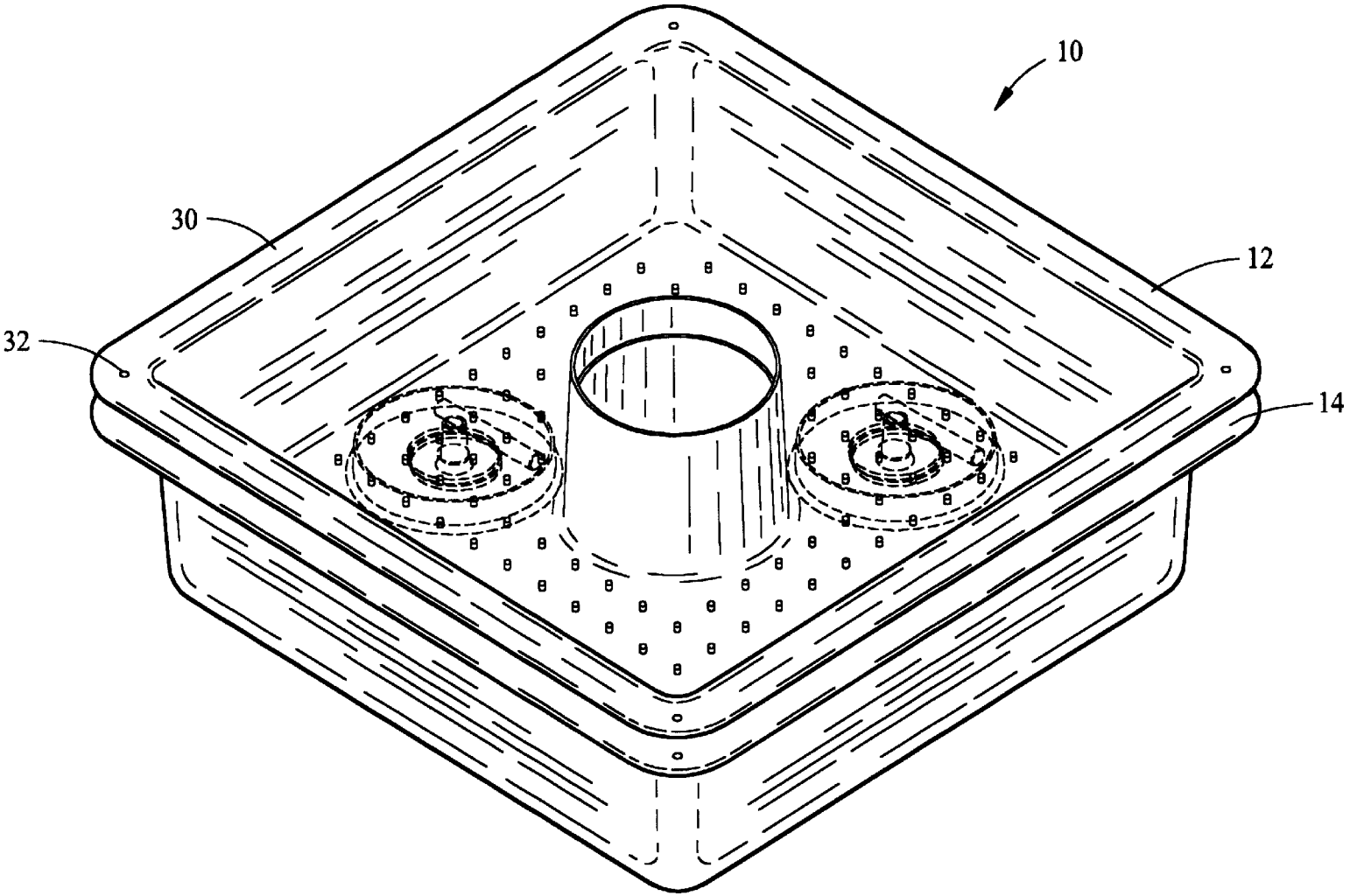
FIG. 7 is a perspective view of a stackable washer tossing game apparatus showing two scoring boxes stacked with base plugs, pins, and washers shown in phantom and stored between the two scoring boxes.
Figure 9:
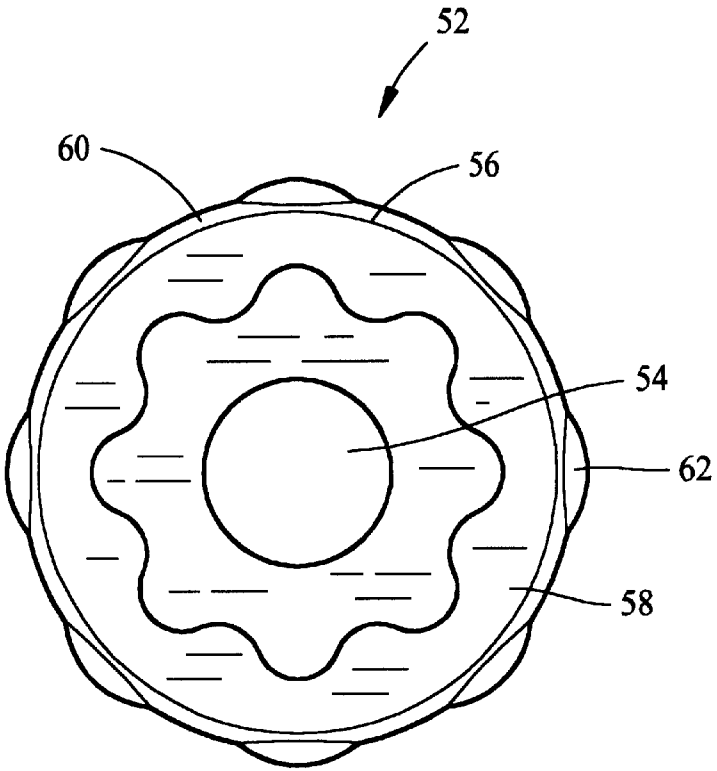
FIG. 9 is a top plan view of an improved washer, having an impact absorbing coating around the outside diameter periphery, of the stackable washer tossing game apparatus.
Figure 8:
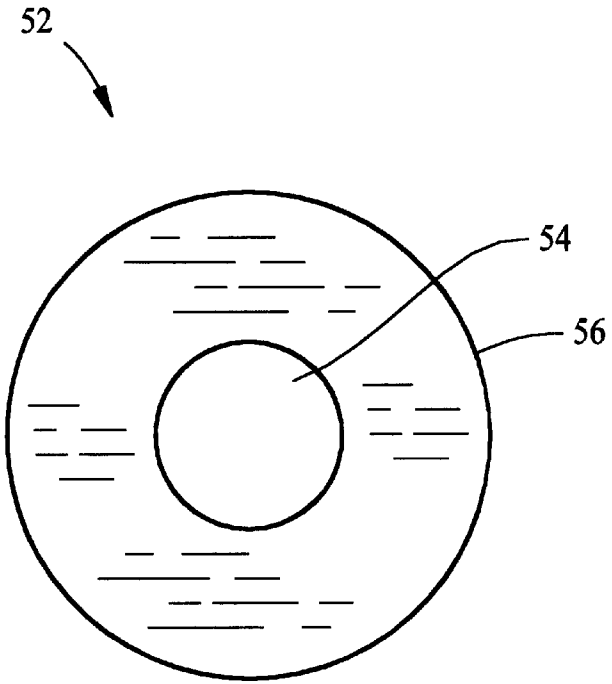
FIG. 8 is a top plan view of a conventional washer of the stackable washer tossing game apparatus.
Figure 10:
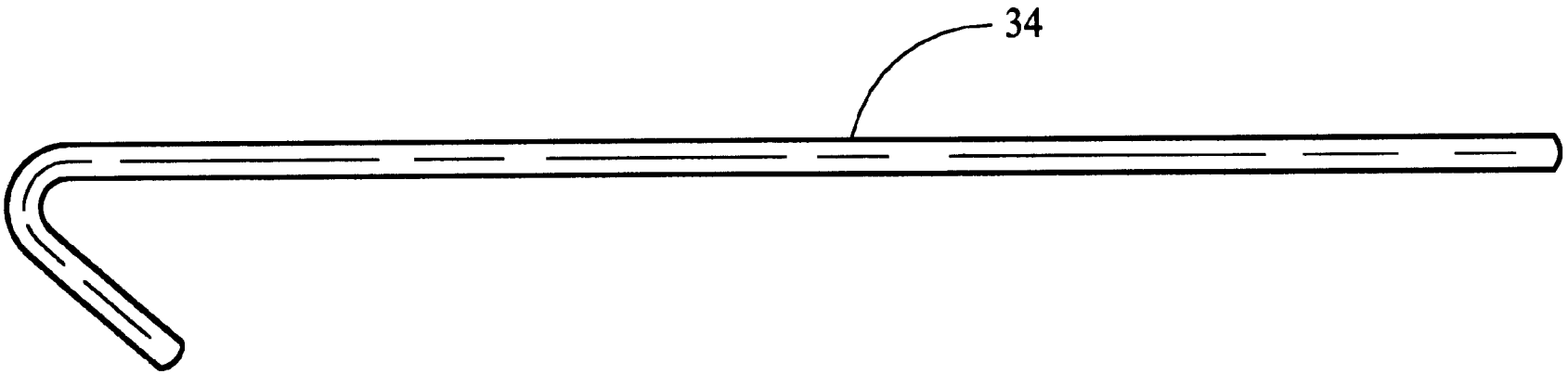
FIG. 10 is a right side plan view of an anchor pin of the washer tossing game apparatus.

Referring now to the drawings, there is shown in FIGS. 1–10 a stackable washer tossing game apparatus and associated components. The stackable washer tossing game apparatus 10 is particularly adapted for ease of storage, transportation, and setup of a washer tossing game. The apparatus 10 provides for a method of washer game play which minimizes washer 52 bounce out of the scoring area or inside 36 and also allows for easy stackability, storage, and transportation of the scoring boxes 12, 14 used with the game.

The drawings show the apparatus comprising at least one but preferably two uniquely formed scoring boxes, 12, 14, a base plug 44 with an optional center scoring pin 48, and one or more washers 52, preferably with an impact absorbing coating 58 on the outside diameter 56.

Each scoring box 12, 14 represents a polygonally cross-section formed open top 16 box having a bottom wall 18, one or more side walls 26 connected thereto, an inside 36, an outside 42, and a raised center portion 38, having a bottom end 39 connected with said bottom wall 18 and a top end 43, within said inside 36. Said center portion 38 has an opening 40 through the center. In a preferred embodiment, the scoring box 12, 14 has a lip 30 around the outermost edge 28 of said side walls 26 extending to the outside 42 of said open top 16. In a preferred embodiment, at least one lip hole 32 is present for placement of at least one anchor pin 34, with preferably a lip hole 32 placed at each comer 15 of said polygonal shape. In a preferred embodiment, the open top 16 box 12, 14 is substantially rectangular and the raised center portion 38 is a slight taper or conic not tapering to an apex, but opened 40 in the center whereby washers 52 may fall for additional point counts. In the preferred embodiment, there are four side walls 26. It is important to note that the scoring box 12, and the raised center portion 38 may be formed in any polygonal cross section shape without departing from the spirit and scope of the present invention, provided the desirable features of the present art are incorporated. It is further noted that the shape and preferred material of said scoring box 12, 14 allows floatation on the surface of water during use. Furthermore, the scoring box 12, 14 with its associated components is preferably molded from a polymer material as a single form and structure.

In the preferred embodiments, the side walls 26 taper inward from the lip 30 to the connection with the bottom wall 18 whereby the distance between parallel side walls 26 is less at the bottom wall 18 than at the lip 30. This tapering allows the scoring boxes 12, 14 to be stacked within each other and form a cavity or void therebetween. This stacking allows for easy storage and transport of washers 52, scoring pins 50, anchor pins 34 and other accessories. Also in the preferred embodiment, the center portion base 41 is of greater width or diameter than said top end 43 and the bottom end 39 is of a greater width or diameter than said top end 43, thereby allowing the top end 43 to fit within said center portion base 41 for stacking purposes.

In the preferred embodiment, into the center portion base 41 from said outside 42 is placed a base plug 44. (The base plug 44 removability option allows for the aforementioned stacking.) Said base plug 44 substantially conforms in size with the center opening 40 of said raised center 38 near said center portion base 41. The base plug 44 preferably has a center hole 46 portion which acts as a center pin mount 50 and into which is mounted a center scoring pin 48. In a preferred embodiment said base plug 44 and said center scoring pin 48 are frictionally held in place, but alternative embodiments may incorporation fasteners, screws, hooks, or other methods.

In a preferred embodiment, the center scoring pin 48 is sized to fit within an inside diameter hole 54 of a washer 52 which is used in the game. The outside diameter 56 of the washer 52 is sized to fit within the center opening 40 of said raised center portion 38. Each washer 52 is coated with user identifiable markings which also act to protect the surface of the washer material. Further alternative embodiments incorporate an impact absorbing coating 58, such as rubber, on all or part of each washer 52 thereby minimizing the bounce of each washer 52 upon impact. In said alternative embodiments, the washer 52 and/or its coating 58 may contain serrations 62, dimples, or other non-uniform formations or moldings on the outside diameter 56 which minimize rolling of said washers 52. Still further alternative embodiments may utilize one or more rings as an accessory to the apparatus and during the method of play instead of said washers, all without departing from the spirit of the present invention.

In the preferred embodiment, a gripping surface 20 is placed on the bottom wall 18 of the inside 36 of said scoring box 12, 14. Said gripping surface 20 slows the movement of the washer 52 when it contacts the bottom wall 18 of the scoring box 12, 14, thereby helping to prevent the washer 52 from bouncing out. In a preferred embodiment, the gripping surface 20 comprises a plurality of projections 22 which extend away from said bottom wall 18. Said projections 22 engage and interfit within the inside diameter hole 54 of said washer and also protrude upon the washer outside diameter 56, thereby limiting washer 52 movement in said scoring box 12, 14. Alternative embodiments may incorporate other means to create a gripping surface 20, 24. These include but are not limited to adhesives, hook and loop fasteners, magnetic attraction, high frictional coefficient materials or vacuum holding. The preferred embodiment further places an outside gripping surface 24, preferably in the form of said plurality of projections 25, on the outside 42 of said bottom wall 18 to limit sliding movement of the scoring box 12, 14.

In preferred operation and use, the players separate the scoring boxes 12, 14 from the stacked and stored position. A base plug 44 preferably having a center scoring pin 48 thereon mounted is placed within the center opening 40 of said raised center portion 38 for each scoring box 12, 14 as previously described. (alternative play methods may forego use of said center scoring pin 48) Each scoring box 12, 14 is then separated approximately 30 feet. Alternative embodiments may separate the scoring boxes 12, 14 more or less than 30 feet. One or more anchor pins 34 may be placed through a lip hole 32 to help secure the scoring box 12, 14 to a surface. As with the center scoring pin 48, anchor pin 34 use is optional. Alternatively, the players may desire to play on a water surface. In this case, the players would simply place the scoring boxes 12, 14 on the water surface and allow them to float in place.

During play, each player obtains marked washers 52, stands near a scoring box 12, 14, and begins tossing toward the other scoring box. In a preferred method of play, if a washer 52 lands within the scoring box 12, 14 but not within the center opening 40, it counts for one point. If a washer 52 lands within the center opening 40 but not onto the center scoring pin 48, it counts for three points. If a washer 52 lands within the center opening 40 and also onto the center scoring pin 48, it counts for five points. In a preferred method, the first player to obtain 21 points wins the game.

From the foregoing description, those skilled in the art will appreciate that all objects of the present invention are realized. A stackable washer tossing game apparatus and method of play which allows a player to easily stack, store, transport, and play a game of washers has been shown and described. The apparatus of this invention provides unique benefits which minimize washer bounce and roll during play.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A stackable washer tossing game apparatus comprising:

a first and a second scoring box, each having an open top of substantially polygonal form, a bottom wall, four side walls, an outermost edge of said sidewalls, an inside defining a cavity, and an outside, said side walls tapering toward said outside and away from said bottom wall in translation from said bottom wall toward said outermost edge of said sidewalls; and a raised center portion within said inside, said raised center portion having a bottom end connected with said bottom wall, a top end opposite said bottom end, a center portion opening through said raised center portion and a center portion base of greater width than said top end, said raised center portion further having a slight taper but not tapering to an apex whereby said bottom end is of a greater width than said top end and said top end of said first scoring box fits within said center portion base of said second scoring box; and said side walls, said center portion, and said cavity formed to allow said first scoring box to stack with said second scoring box cavity, thereby allowing the outside of said second scoring box to fit within the inside of said first scoring box and further allowing stacking of said scoring boxes; and two removable base plugs, each having a diameter substantially equivalent to said center portion base whereby said base plug may fit within said center portion base; and said base plugs, both sized to store between said stacked scoring boxes.

2. The stackable washer tossing game apparatus as set forth in claim 1 further comprising:

a center hole within said base plug forming a center pin mount; and a center scoring pin held within said center pin mount.

3. The stackable washer tossing game apparatus as set forth in claim 1 further comprising:

a bottom wall inside gripping surface on said bottom wall inside said scoring box, said gripping surface capable of limiting movement of a washer.

4. The stackable washer tossing game apparatus as set forth in claim 1 further comprising:

a bottom outside gripping surface on said bottom wall outside said scoring box.

5. The stackable washer tossing game apparatus as set forth in claim 4, wherein:

said bottom outside gripping surface comprises a plurality of projections on said bottom wall.

6. The stackable washer tossing game apparatus as set forth in claim 1 further comprising:

two center scoring pins, each removably mounted within a center pin mount in each of said base plugs, said scoring pins sized to store between said stacked scoring boxes; and one or more washers having an inside diameter hole and an outside diameter, said inside diameter hole of sufficient size to fit over said center scoring pin and said outside diameter smaller than said center portion opening.

7. The stackable washer tossing game apparatus as set forth in claim 6, said one or more washers further comprising:

an impact absorbing coating attached onto said one or more washers.

8. The stackable washer tossing game apparatus as set forth in claim 7 wherein:

said impact absorbing coating is substantially located near said outside diameter to form a peripheral covering; and said combination of said outside diameter of said washer and said peripheral covering forming a substantially serrated edge, said serrated edge capable of minimizing rolling of said washer.

9. A stackable washer tossing game apparatus comprising:

a first and a second scoring box, each having an open top of substantially polygonal form, a bottom wall, four side walls, an outermost edge of said sidewalls, an inside defining a cavity, and an outside, said side walls tapering toward said outside and away from said bottom wall in translation from said bottom wall toward said outermost edge of said sidewalls; and a raised center portion within said inside, said raised center portion having a bottom end connected with said bottom wall, a top end opposite said bottom end, a center portion opening through said raised center portion and a center portion base of greater width than said top end, said raised center portion further having a slight taper but not tapering to an apex whereby said bottom end is of a greater width than said top end and said top end of said first scoring box fits within said center portion base of said second scoring box; and said side walls, said center portion, and said cavity formed to allow said first scoring box to stack with said second scoring box cavity, thereby allowing the outside of said second scoring box to fit within the inside of said first scoring box and further allowing stacking of said scoring boxes; and a bottom wall inside gripping surface on said bottom wall inside said scoring box, said gripping surface capable of limiting movement of a washer; and said bottom wall inside gripping surface comprises a plurality of projections, said projections sized and positioned to engage and interfit within an inside diameter hole of said washer and also protrude upon an outside diameter of said washer.

10. A stackable washer tossing game apparatus comprising:

a first and a second scoring box, each having an open top of substantially polygonal form, a bottom wall, four side walls, an outermost edge of said sidewalls, an inside defining a cavity, and an outside, said side walls tapering toward said outside and away from said bottom wall in translation from said bottom wall toward said outermost edge of said sidewalls; and a raised center portion within said inside, said raised center portion having a bottom end connected with said bottom wall, a top end opposite said bottom end, a center portion opening through said raised center portion and a center portion base of greater width than said top end, said raised center portion further having a slight taper but not tapering to an apex whereby said bottom end is of a greater width than said top end and said top end of said first scoring box fits within said center portion base of said second scoring box; and said side walls, said center portion, and said cavity formed to allow said first scoring box to stack with said second scoring box cavity, thereby allowing the outside of said second scoring box to fit within the inside of said first scoring box and further allowing stacking of said scoring boxes; and a lip on said outermost edge of said sidewalls; and one or more lip holes in said lip; and one or more anchor pins placed through said lip holes.

11. A stackable washer tossing game apparatus comprising:

one or more scoring boxes, each having an open top of substantially polygonal form, a bottom wall, four side walls, an outermost edge of said sidewalls, an inside defining a cavity, and an outside, said side walls tapering toward said outside and away from said bottom wall in translation from said bottom wall toward said outermost edge of said sidewalls whereby substantially parallel sidewalls are separated farther at said outermost edge than at said bottom wall; and a raised center portion within said inside, said raised center portion having a bottom end connected with said bottom wall, a top end opposite said bottom end, a center portion opening and center portion base of greater width than said top end, said raised center portion further having a slight taper but not tapering to an apex whereby said bottom end is of a greater width than said top end and said top end fits within said center portion base thereby allowing the outside of said scoring boxes to fit within the inside of said scoring boxes and further allowing stacking of said scoring boxes; and a base plug having a width substantially equivalent to said center portion base, a center hole within said base plug forming a center pin mount, and a center scoring pin held within said center pin mount, said base plug frictionally held within said center portion base; and a bottom wall inside gripping surface on said bottom wall inside said scoring box; and a lip on said outermost edge of said sidewalls.

12. A stackable washer tossing game apparatus comprising:

one or more washers having an inside diameter hole and an outside diameter, said outside diameter smaller than a center portion opening of a scoring box; and an impact absorbing coating attached onto said one or more washers near said outside diameter and forming a peripheral covering, said peripheral covering having one or more dimples thereupon whereby rolling of said washer is minimized and said impact absorbing coating minimizes bounce of said washer when tossed.

* * * * *